US005205001A

United States Patent [19]

O'Connell

[11] Patent Number: 5,205,001

[45] Date of Patent: Apr. 27, 1993

[54] PORTABLE SHOWER FOR INVALID USE

[76] Inventor: Ann O'Connell, 700 Peter Paul Dr., West Islip, N.Y. 11795

[21] Appl. No.: 972,121

[22] Filed: Nov. 5, 1992

Related U.S. Application Data

[63] Continuation-in-part of Ser. No. 711,926, Jun. 7, 1991, which is a continuation-in-part of Ser. No. 481,250, Feb. 20, 1990, abandoned, which is a continuation-in-part of Ser. No. 340,720, Apr. 20, 1989, abandoned.

[51] Int. Cl.[5] ..... A47R 3/06

[52] U.S. Cl. ..... 4/599; 4/604

[58] Field of Search ..... 4/596, 599, 585, 587, 4/600–602, 604, 612–614

[56] References Cited

U.S. PATENT DOCUMENTS

| | | | |
|---|---|---|---|
| 778,641 | 12/1904 | Dudley et al. | 4/585 |
| 1,307,942 | 6/1919 | Volters | 4/587 |
| 2,014,554 | 9/1935 | Bulthuis | 4/599 |
| 2,239,969 | 4/1941 | Morthland | 4/613 X |
| 2,641,770 | 6/1953 | Chapin | 4/602 X |
| 3,334,360 | 8/1967 | Hoxeng et al. | 4/585 |
| 3,366,978 | 2/1968 | Jones | 4/587 X |
| 4,413,363 | 11/1983 | Troiano | 4/599 |
| 4,675,923 | 6/1987 | Ashley | 4/599 |
| 4,785,486 | 11/1988 | Viesturs | 4/585 |

*Primary Examiner*—Charles E. Phillips
*Attorney, Agent, or Firm*—Alfred M. Walker

[57] ABSTRACT

A portable collapsible shower structure for accommodating invalid persons has an expandable shower enclosure unit which extends substantially vertically in a working condition and limit an inner space for accommodating an invalid person, and a bottom which is sealingly connected with the shower enclosure unit to capture water during taking a shower and to prevent its spillage.

3 Claims, 4 Drawing Sheets

PORTABLE SHOWER FOR INVALID USE

BACKGROUND OF THE INVENTION

This application is a continuation-in-part of application No. 07/711,926, filed Jun. 7, 1991, which is a continuation in part of application Ser. No. 07/481,250, filed Feb. 20, 1990, now abandoned which is a continuation-in-part of application Ser. No. 07/340,720, filed Apr. 20, 1989 now abandoned.

FIELD OF THE INVENTION

The present invention relates to a portable shower. More particularly, it relates to a portable shower for invalid persons who cannot mobilize themselves to lift their legs over the tub or stall shower lip at home, or walk up stairs or to other rooms to be cleaned, etc.

BACKGROUND OF THE INVENTION

Portable showers are generally known in the art. In the conventional shower structures the shower is administered through a shower head which pours water into an enclosed area defined basically by four hanging curtain walls. Such structures are disclosed for the example in U.S. Pat. No. 8,723 of Holm, U.S. Pat. No. 778,641 of Dudley, U.S. Pat. No. 991,222 of Miller, U.S. Pat. No. 1,307,942 of Volters, U.S. Pat. No. 1,450,218 of Nenuff, U.S. Pat. No. 1,663,735 of Talbot, U.S. Pat. No. 2,239,969 of Northland, U.S. Pat. No. 2,852,784 of Winter, U.S. Pat. No. 3,293,664 of Coons, U.S. Pat. No. 3,334,360 of Hoxeng, U.S. Pat. No. 3,366,978 of James, U.S. Pat. No. 3,606,618 of Veech, U.S. Pat. No. 3,657,746 of Downey, U.S. Pat. No. 3,925,828 of Kim, U.S. Pat. No. 4,170,795 of Hahn, U.S. Pat. No. 4,171,595 of Tucker, U.S. Pat. No. 4,453,280 of Greenleaf, and U.S. Pat. No. 4,785,486 of Viesturs. However, the conventional shower structures do not have a sealed bottom which opens flush to the floor. This lack of a shower entrance flush to the floor presents a big problem when an invalid person is being showered in a bathroom, a kitchen, a bedroom or other areas wherein it is not desired to have water splash out onto rugs, upholstery, and other objects, or when a person cannot step up into a shower structure. Finally, the existing shower structures are narrow, and cannot accommodate a person lying in a horizontal position upon a stretcher or a gurney.

OBJECTS OF THE INVENTION

Accordingly, it is an object of the present invention to provide a shower structure which avoids the disadvantages of the prior art.

More particularly, it is an object of the present invention to provide a shower structure which is sealed so as to prevent leakage and spillage of water and at the same time permits easy access at a floor level.

It is a further object of the present invention to provide a shower structure which can accommodate a person in a vertical position, and in addition can also accommodate a person in a horizontal position, for example, lying on a stretcher or a gurney.

It is a further object of the invention to provide a portable shower structure which has a foldable opening means, flush to the floor, to permit a wheelchair to be wheeled in, which means can be folded back to provide a secure seal against water leakage.

It is a further object of the invention to improve over the disadvantages of the prior art.

SUMMARY OF THE INVENTION

In keeping with these objects and with others which will become apparent hereinafter, one feature of the present invention resides, briefly stated, in a shower structure which has a generally flat floor, a holding frame portion, and a four sided flexible and collapsible shower enclosure unit extending substantially vertically in a working condition and limiting an inner space for accommodating an invalid person.

The four sided shower enclosure unit includes two side wall portions, one edge of each side wall portion being connected by a seam to respective edges of a rear wall portion, and a front door portion connected at its side edges to adjacent side edges of the two vertical side wall portions by a pair of connecting means, such as zippers, for opening the front door portion outward, by opening each of the two vertical connecting means, by unzipping or otherwise.

When the shower structure is thus opened, only the bottom horizontal edge of the front door remains connected to a front edge of the shower structure at the floor level.

The shower structure also includes a bottom basin insertable within the bottom of the shower enclosure unit to capture water during taking a shower and to prevent its spillage. The insertable bottom basin portion includes four vertical walls and one horizontal bottom floor. One of the four vertical walls is hinged, to open flat to the floor.

In another embodiment, three of the four vertical walls of the basin may be sealingly connected, by heat or sewing, to the corresponding lower surfaces of the aforementioned flexible and collapsible shower enclosure unit portion. In this embodiment, the front fourth wall with hinged flaps coterminously connected with the front wall portion is attached at its upper edge to a lower portion of the fourth, front wall of the flexible collapsible shower enclosure unit to permit access at floor level into the shower structure.

When the shower structure is designed in accordance with the present invention, it is sealed so that during taking a shower water cannot escape from it, and therefore the shower structure can be used in any place without a risk of spoiling surrounding objects with water.

As noted, of the present invention including the shower structure is provided with a pair of parallel, vertically adjustable zippers, each including a dual zipperguide with vertically ascending and vertically descending dual zippermembers movable in the guide. Thereby an opening can be formed in the shower structure, by lowering each parallel, vertically descending zippers down to the floor, and therefore the front wall portion down to the floor. It is noted that the top of the front wall portion is not connected to the holding frame, so that when the dual zippers are unzipped, the front wall portion can collapse down to its bottom edge at the floor level.

In accordance with another alternative feature of the present invention, the holding frame portion of the inventive shower structure may be provided in a larger structure in a horizontal direction to accommodate a person in a horizontal position, for example, lying on a stretcher or gurney. In such an embodiment, an alternative larger shower enclosure unit, with larger side portions, and an alternate larger frame is required to accommodate the larger shower structure. In such an enlarged embodiment, the front and rear wall portions are smaller than the two side wall portions.

The novel feature of the present invention are set forth in particular in the appended claims. The invention itself, however, both as to its construction and its manner of operation will be best understood from the following description of preferred embodiments of the invention, which is accompanied by the following drawings illustrating the present invention.

DESCRIPTION OF PREFERRED EMBODIMENT

Figure 1:
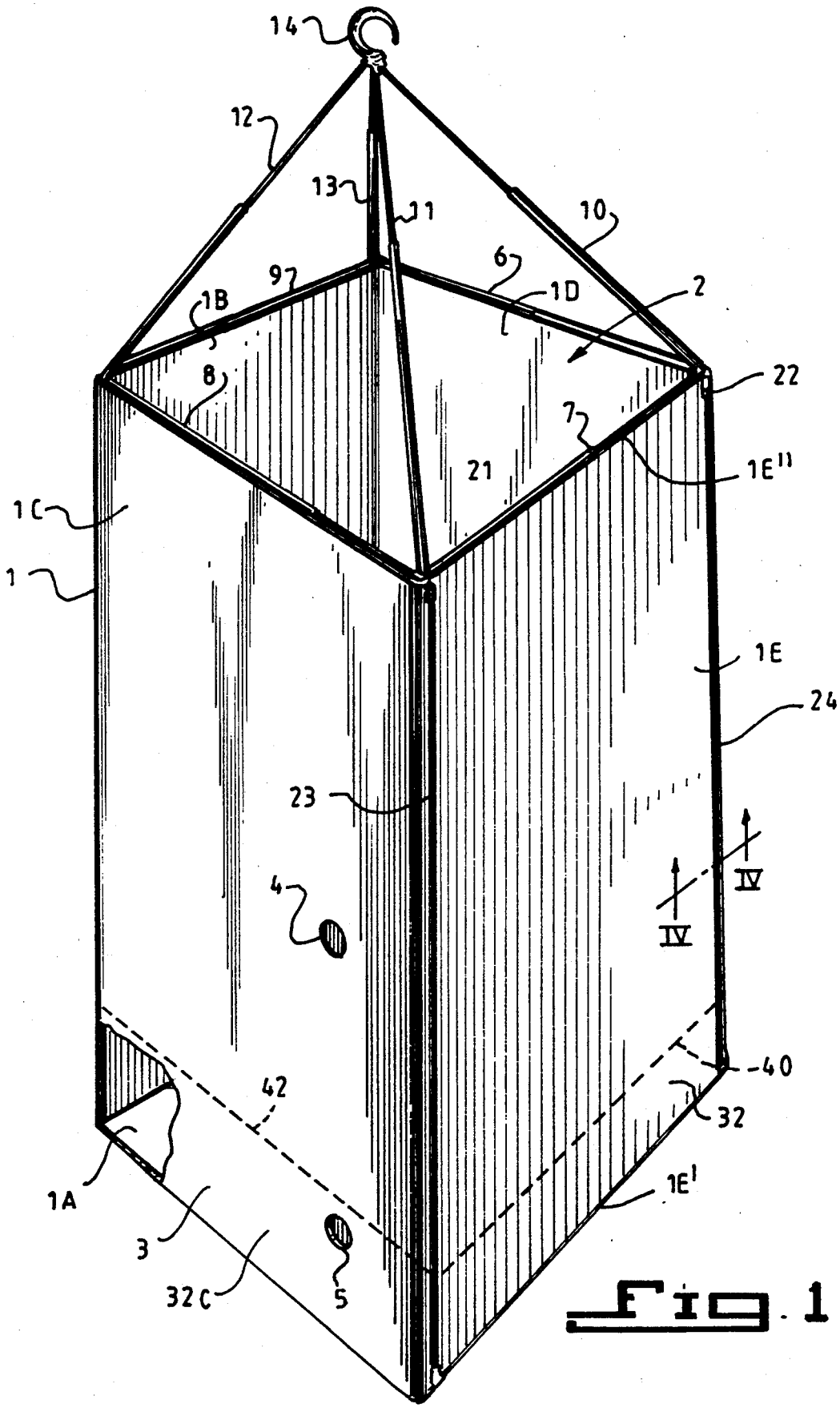
FIG. 1 is a perspective view of a shower structure in accordance with the present invention with a built in basin.

As shown in FIGS. 1, 6A, 6B and 6C, a shower structure in accordance with the present invention has a flexible and collapsible shower enclosure unit which is identified as a whole with reference numeral 1. The shower enclosure unit 1 in a working condition extends substantially vertically and limits an inner space 2 for accommodating a person taking a shower. The shower enclosure unit 1 can be composed of any existing water resistant material.

Shower enclosure unit 1 includes a generally flat floor 1A, a rear wall portion 1B sealingly connected at a common edge to one edge of side wall portion 1C and sealingly connected at a common edge to one edge of side wall portion 1C and sealingly connected at a further common edge to one edge of further side wall portion 1D.

To enter the shower structure, front wall portion 1E folds down by the unzipping of zippers 21 and 22. Dual zipper21 moves down within dual zipper guide 23 and zipper 22 moves down within dual zipper guide 24. Dual zipper guide 23 forms a removable edge between side wall portion 1C and front wall portion 1E. Dual zipper guide 24 forms a further removable edge between side wall portion 1D and front wall portion 1E.

When dual zippers 21 and 22 are moved down to floor portion 1A, front wall portion 1E opens hingably about its bottom edge 1E'. It is noted that the top edge 1E" is not connected to frame member 7, so that top edge 1E" may be moved outward from frame member 7 when opening front wall portion 1E.

A bottom basin 3 with four upwardly extending lip walls 32, **32*a*, 32*b*, 32*c* may be placed within the shower enclosure unit 1 at a lower edge of the latter. The bottom basin 3 is also composed of a water-resistant material, for example rubber or plastic. Three upper vertical edges 41, 42 and 43 of the lip walls 32*a*, 32*b*, 32*c* of bottom basin, define the top edges of basin 3**.

Figure 6A:
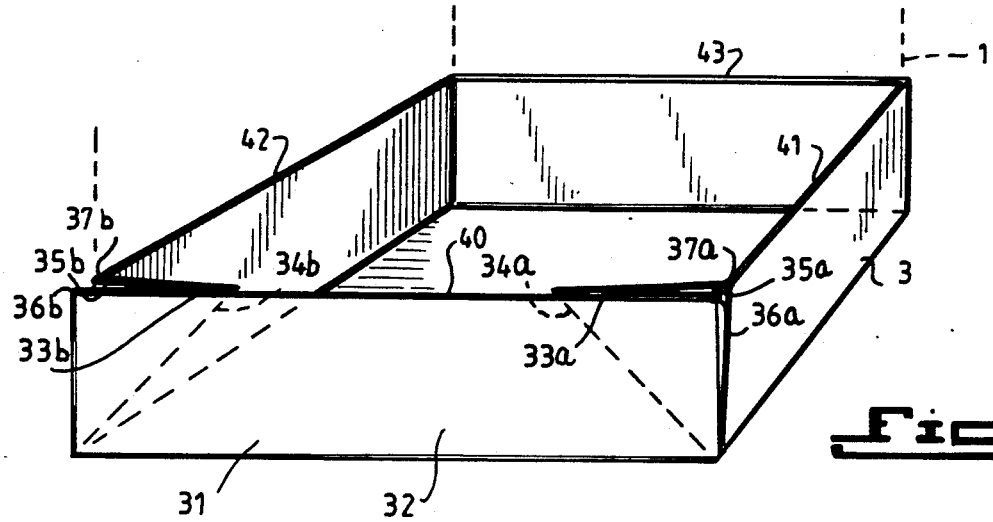
FIG. 6A is a perspective view of the basin portion in a closed position.
Figure 6B:
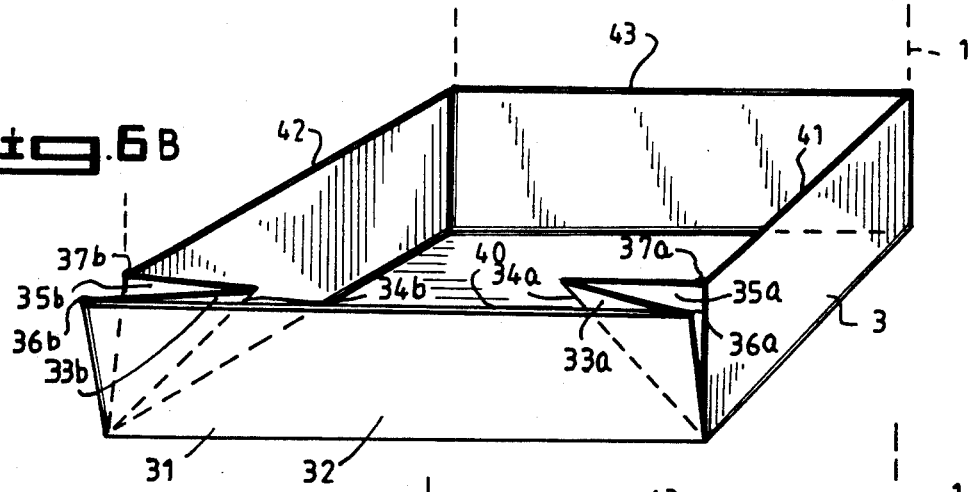
FIG. 6B is a perspective view of the basin portion in a partial open position; and, FIB. 6C is a perspective view of the basin portion in a fully opened position.
Figure 6C:
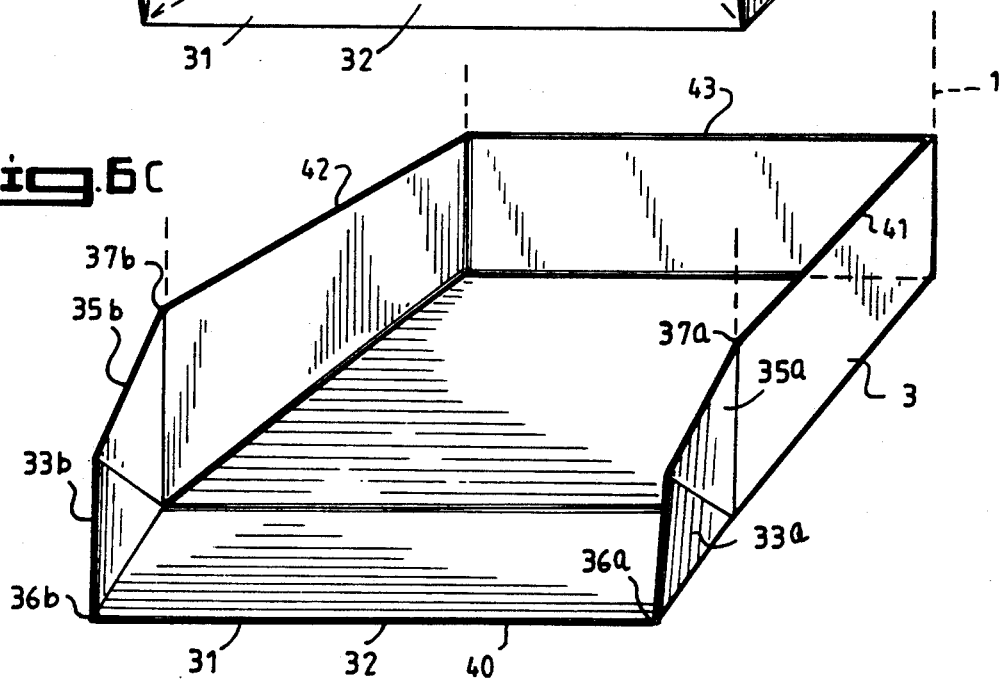

The front, fourth upper edge 40 of bottom basin 3 opens up as explained hereinafter below, so the upper vertical edge 40 of front upwardly extending lip wall flap 32 of bottom basin 3 opens outward from a vertical position as shown in FIG. 6A, to a horizontal position as shown in FIG. 6C.

To permit the floor level entry of wheelchairs or the feet of persons who have difficulty in raising the feet, into bottom basin 3, there is provided opening wall portion 31 including a front portion 32 and first hinged portion flaps **33*a* and 33*b*, each flap 33*a* or 33*b* connected along diagonal axis edges 34*a* and 34*b* respectively, to further hinged flaps 35*a* and 35*b* including reciprocal joints such as snaps 36*a* and 36*b*, which joints 36*a* and 36*b* are connected to reciprocal joints means 37*a* and 37*b***.

In one embodiment wherein flap 32 is sealingly connected to front curtain portion 1E flap 32 extends down to a horizontal position by the extension of triangular portions **33*a* and 35*a* so that they are coterminously stretched along axis 34*a* and 34*b* in an open position. The hinged portions 33*a*, 33*b*, 35*a*, 35*b* and flap 31 are made from a waterproof material to provide a watertight fit for bottom basin 3. Triangular hinged portion 33*a* and 33*b* are connected to triangular portion 35*a* and 35*b* by means of reciprocal joints 36*a*, 36*b*, 37*a* and 37*b*** as shown.

In another embodiment, it is anticipated that basin 3 can also be a self contained removable unit, which is placed within shower enclosure 1 above floor portion 1A.

The shower enclosure unit I has conventional openable and sealable hole 4 for water entry and conventional openable and sealable hole 5 for water drainage. A hose with a shower head can be introduced through the hole 4 into the inner space 2 of the shower structure, and a drain hose can be connected with the drainage hole 5.

As further shown in FIG. 1, the shower structure has a frame provided at the upper edge of the shower enclosure unit 1 and includes frame members or rods 6, 7, 8, 9, which rods are held up by hook attachment member 14, which hook attachment member 14 is connected to the four corners formed by frame members or rods 6, 7, 8 and 9 by corresponding connecting inclined support rod members 10, 11, 12 and 13 respectively.

Inclined rods 10, 11, 12 and 13 extend upwardly at an angle relative to a central vertical axis of the shower enclosure unit 1 and are connected at their upper end with hook 14. The shower structure in accordance with the present invention can therefore be suspended on the hook 14 to extend vertically. On the other hand, the shower enclosure unit 1 can be provided with an alternate conventional free standing pole (not shown). In this case, the shower structure can stand on a supporting surface, for example on a room floor, etc.

Figure 4:
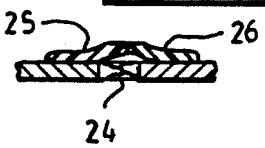
FIG. 4 is a view showing a section taken along the line IV—IV in FIG. 1 and illustrating a region of a dual zipper with a seal.

As shown in FIG. 4, for sealingly closing the regions of the dual zipper guides 23 and 24, each dual zipper guide 23 and 24 is associated with a sealing element located at the inner side of the zipper. Each sealing element includes two sealing strips 25 and 26 located at opposite side of the dual zipper and having a bulged leading portion.

In the closed portion of the dual zipper shown in FIG. 4, the bulged leading portions of the sealing strips 25 and 26 firmly abut against one another with partial compression and reliably seal the dual zipper guide 24 from a water leakage outwardly of the inner space through the dual zipper.

Figure 2:
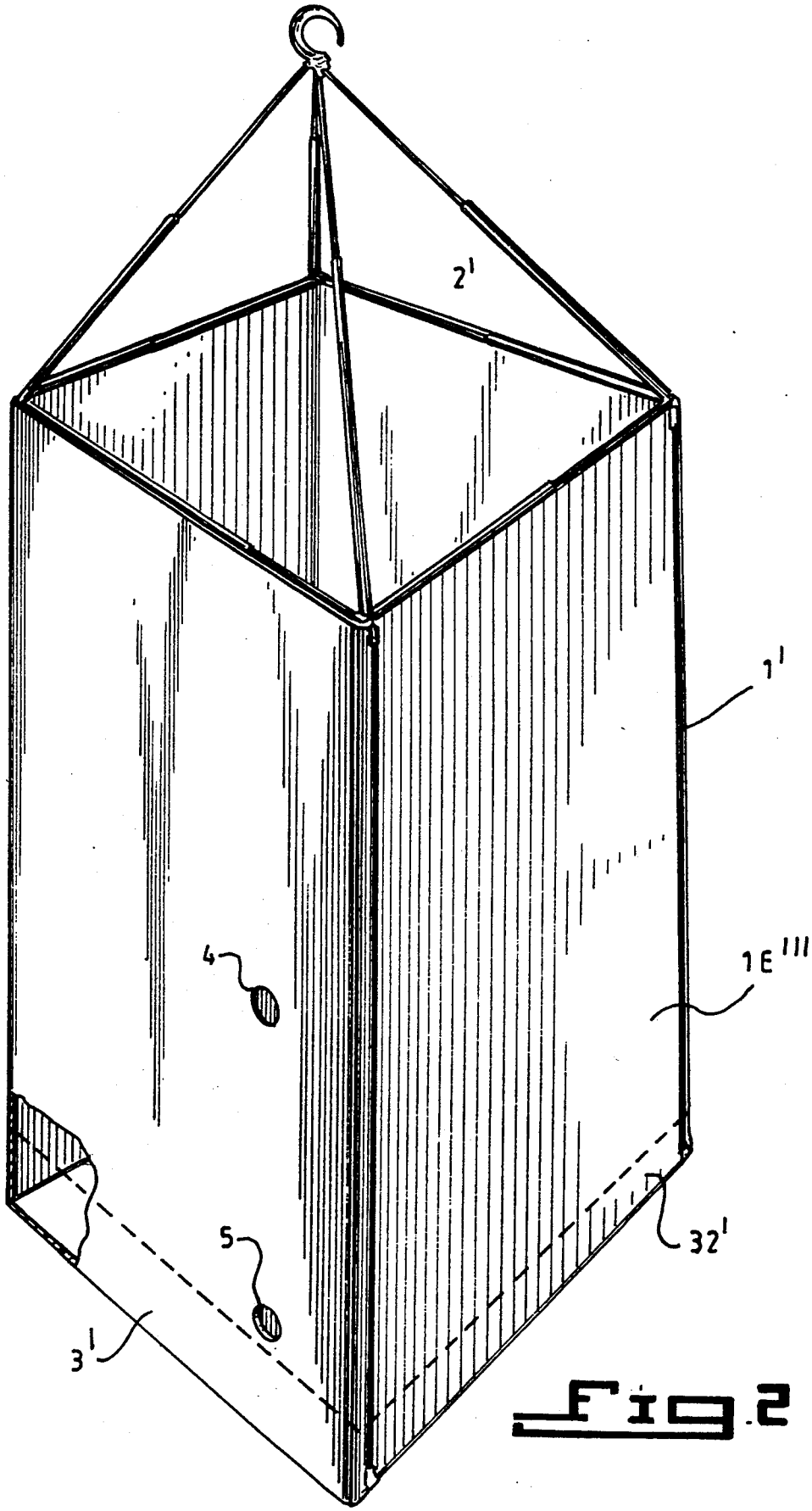
FIG. 2 is a perspective view of an alternate embodiment of the present invention with a removable basin.
Figure 3:
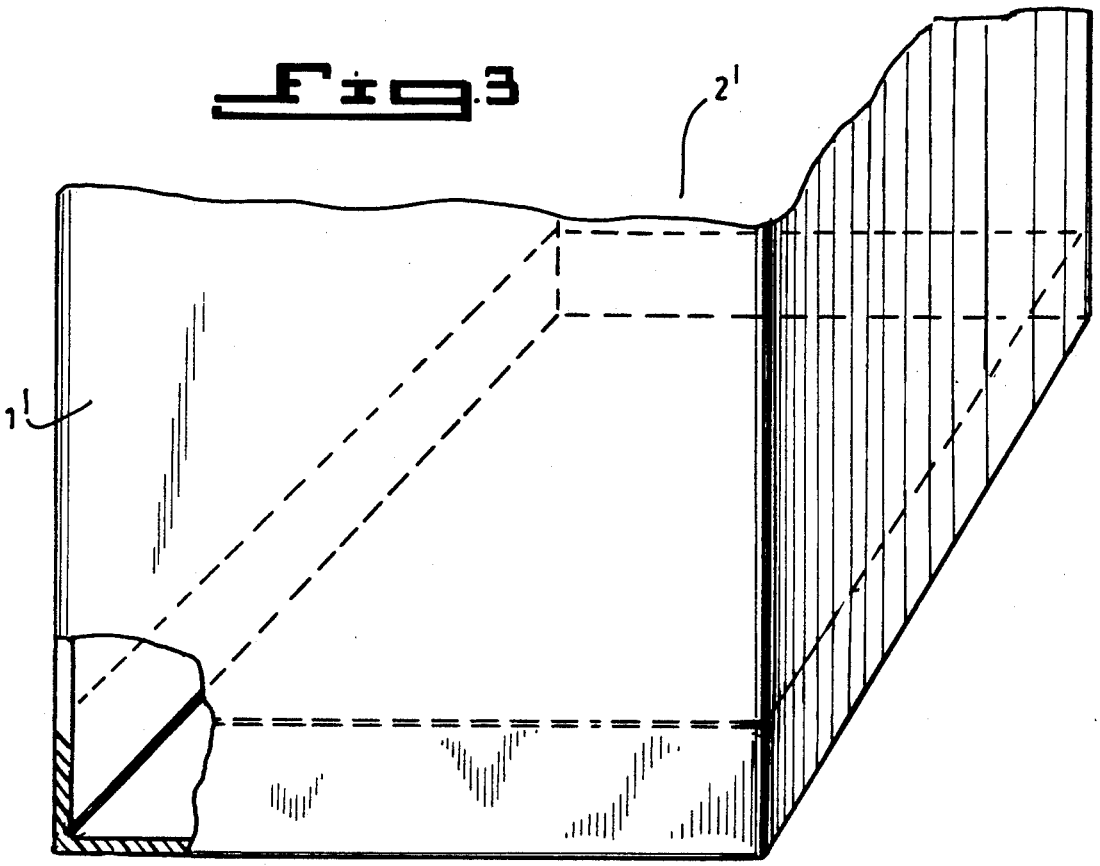
FIG. 3 is a partial close-up view of a shower structure in accordance with a further embodiment of the invention.

In the embodiment shown in FIG. 2, the bottom basin 3' is removable from the lower part of the shower enclosure unit 1'. Therefore, in this embodiment, when front wall portion 1E''', opens down, then flap 32' also opens down.

Moreover, in the embodiment shown in FIG. 2, drainage hole 5', which is closable by conventionally plugging or with a rotatable valve means, is located above the top edge of basin 3', since basin 3' is a self standing, removable basin, which can be manually drained of water.

Figure 5:
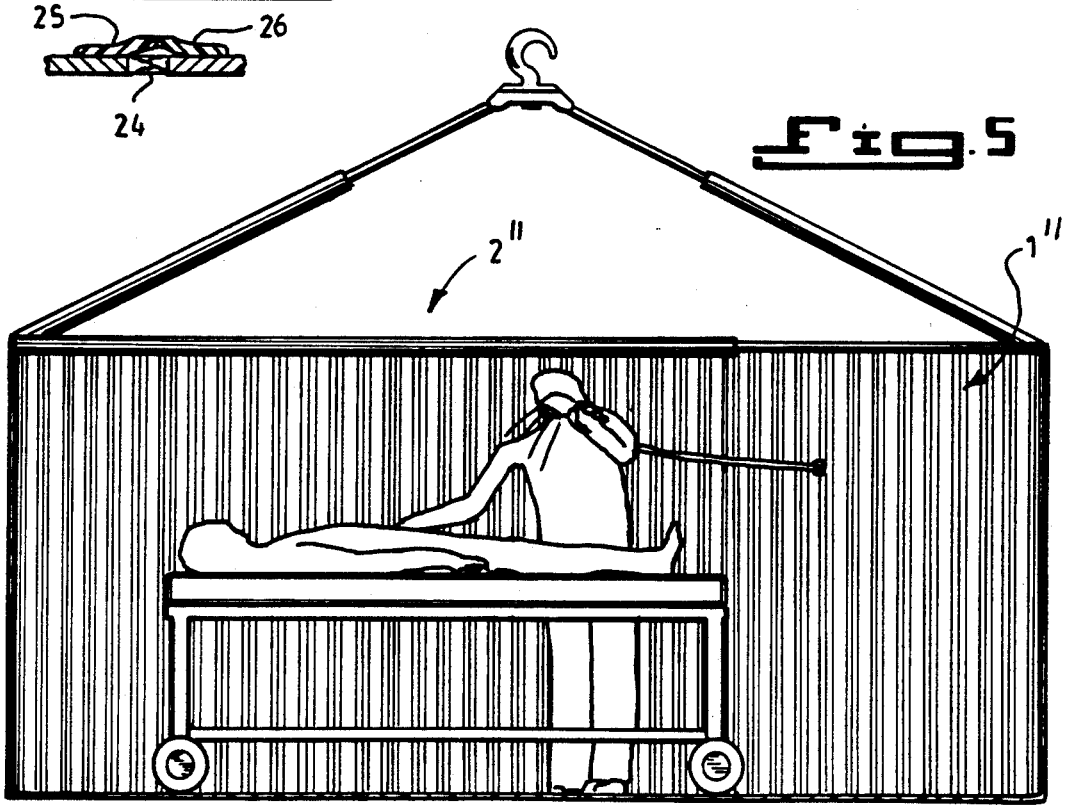
FIG. 5 is a view showing an inventive shower structure in a horizontally expanded condition to accommodate a lying person.

As shown in the enlarged embodiment shown in FIG. 5, the frame rods and can be constructed in a larger size to accomodate an larger inner space 2''. However, when the shower structure is thus provided in an increased size, it becomes necessary to have a larger shower enclosure unit 1'' to accommodate the larger frame thus formed.

Therefore, in the embodiment shown in FIG. 5, the shower structure unit 1'' can accommodate a person lying in a horizontal position, for example on a stretcher or gurney. In this embodiment, a larger basin must also be provided to accommodate the larger interior space 2''.

The invention is not limited to the details shown since various modifications and structural changes are possible without departing in any way from the spirit of the present invention. What is desired to be protected by Letters Patent is set forth in particular in the appended claims.

I claim:

1. A portable collapsible shower structure for accommodating invalid persons, comprising:

a collapsible shower enclosure unit extending substantially vertically in a working condition and limiting an inner space for accommodating an invalid person;

said collapsible shower enclosure unit including a first front wall portion having opposite vertical side edges, a lower edge and a top edge, a rear wall portion, a floor portion, and a plurality of side wall portions, said floor portion integral with said front wall portion, said rear wall portion and said plurality of side wall portions;

a bottom basin portion within said shower enclosure unit at a bottom of said shower enclosure unit, said basin capable of capturing water during taking a shower and capable of preventing spillage of said water;

said bottom basin having a plurality of upwardly extending lip walls extending upwardly within said shower enclosure unit;

a door in said first wall position to permit the entry and exit of persons or limbs of persons using said shower;

said door including said front wall portion being removably attached on either side to a side wall portion, said front wall portion being removable adjacent to respective opposite edges of said side wall portions by respective dual zippers within a corresponding dual zipper guide at each said vertical edge of said first wall portion, sealing means for sealing said dual zippers wherein said sealing means includes two elongated sealing strips arranged, one on each side of each said dual zipper guide and sealingly abutting against one another in a closed position of said dual zipper guides;

means for supporting said collapsible shower enclosure unit in a vertical orientation;

an opening means for supplying water and an opening means for withdrawing waste water each located in said unit;

a means for opening a portion of said bottom basin portion comprising an upwardly extending front vertical lip wall flap connected to the remainder of said basin by two hinged means each having two coterminous right triangular extendable flap portions sealingly connected along a common axis formed by the largest side of said triangles;

said front vertical lip wall flap being openable flush to the floor level by extension of said triangular portions along their common coterminal axis, in a fully extended position with said triangular portions in a common plane to permit the said flap to extend outwardly in a horizontal position from its vertical erect position;

the walls of said bottom basin portion being encased in waterproof material to permit watertight closure of said flap in an upward closed position.

2. The invention as in claim 1 wherein said bottom basin portion is removable from said shower enclosure unit.

3. The invention as in claim 1 wherein said bottom basin is sealingly connected to said shower enclosure unit.

* * * * *